United States Patent [19]

Weinstein

[11] Patent Number: 4,588,320

[45] Date of Patent: May 13, 1986

[54] CLOSURE FOR ROLL-ON APPLICATOR

[75] Inventor: Jack Weinstein, Old Bridge, N.J.

[73] Assignee: Bristol-Myers Company, New York, N.Y.

[21] Appl. No.: 200,704

[22] Filed: Oct. 27, 1980

[51] Int. Cl.[4] ..... B43K 7/00

[52] U.S. Cl. ..... 401/213; 400/209

[58] Field of Search ..... 401/209, 213, 210

[56] References Cited

U.S. PATENT DOCUMENTS

| | | | |
|---|---|---|---|
| 2,536,924 | 1/1951 | Fehling | 120/42.4 |
| 2,749,566 | 6/1956 | Thomas | 15/132.7 |
| 2,937,392 | 5/1960 | Williams | 401/213 |
| 2,976,561 | 3/1961 | Culver | 401/213 |
| 2,998,616 | 9/1961 | Gentile | 401/213 |
| 3,036,328 | 5/1962 | Schaich | 401/213 |
| 3,134,131 | 5/1964 | Thomas | 15/571 |
| 3,137,886 | 6/1964 | De Groft | 401/213 |
| 3,523,628 | 8/1970 | Colvin et al. | 401/213 |
| 4,002,411 | 1/1977 | Harbauer | 401/213 |
| 4,021,125 | 5/1977 | Berghahn et al. | 401/213 |
| 4,030,844 | 6/1977 | Lench et al. | 401/213 |
| 4,051,974 | 10/1977 | Gentile | 215/329 |
| 4,091,948 | 5/1978 | Northup | 215/222 |
| 4,164,377 | 8/1979 | Lehrman et al. | 401/213 |
| 4,168,128 | 9/1979 | Gillmore et al. | 401/213 |
| 4,221,494 | 9/1980 | Kachur | 401/213 |

*Primary Examiner*—William Pieprz

*Attorney, Agent, or Firm*—Gabriel P. Katona

[57] ABSTRACT

A closure adapted to use on a roll-on dispenser and especially in connection with dispensing a liquid composition containing a major quantity of a liquid volatile silicone; said closure including a skirt depending from the inner surface of the roof of the closure which skirt serves as a sealing means when the closure is mounted on the roll-on dispenser, said skirt being provided with a plurality of supporting braces which prevent the flaring of the skirt when it is mounted in sealing engagement on the dispenser.

5 Claims, 3 Drawing Figures

CLOSURE FOR ROLL-ON APPLICATOR

This invention relates to a closure for a container and more particularly, for a closure that is useful in conjunction with a roll-on type dispenser.

Roll-on dispensers have long been known in the prior art and have been widely used as dispensers for antiperspirant lotion type products. A device of this kind is disclosed in the U.S. Pat. to Thomas No. 2,749,566. The dispenser of this patent is provided with a closure or cap which when screwed onto the top of the dispenser bottle finally engages a ring which bears against the dispenser ball and thus, forms a seal.

The system described in U.S. Pat. No. 2,749,566 was found to be adequate for water-based antiperspirant systems. However, more recently, the trend has been to eliminate water from these systems to avoid the wet feel which is sometimes associated with the application of water-based products. In an effort to get away from the water-based systems, some recent products have replaced the water with a liquid silicone and usually with a volatile liquid silicone.

However, with the new silicone based formulations, problems were encountered. One of these was the fact that the sealing which was afforded by the closure on a dispenser like that shown in U.S. Pat. No. 2,749,566 was not adequate. It was found that when the silicone based formulas were packaged in these containers with their closures applied and subjected to the conventional leaking tests, there were many failures i.e. there were many cases in which the liquid product leaked out of the container.

In an effort to find a container which would provide a better seal, a dispenser and closure system of the type disclosed in U.S. Pat. No. 4,164,377 was also tested. However, these were also found to leak to an unacceptable degree.

It has now been found that a satisfactory system can be obtained by providing a closure member for the dispenser system which is characterized by the fact that it has a skirt that depends from the upper inner surface of the closure and which preferably forms at the point of juncture with said upper inner surface an angle which is substantially a right angle. The closure is further characterized by the fact that the depending skirt is provided with supporting ribs to minimize the deformation of the skirt when the closure is mounted on the container.

It is accordingly an object of the present invention to provide a closure means especially adapted for a roll-on dispenser which eliminates or minimizes the leaking of the liquid contents of said container.

Other and more detailed objects of this invention will be apparent from the following description, claims and drawings in which:

Figure 1:
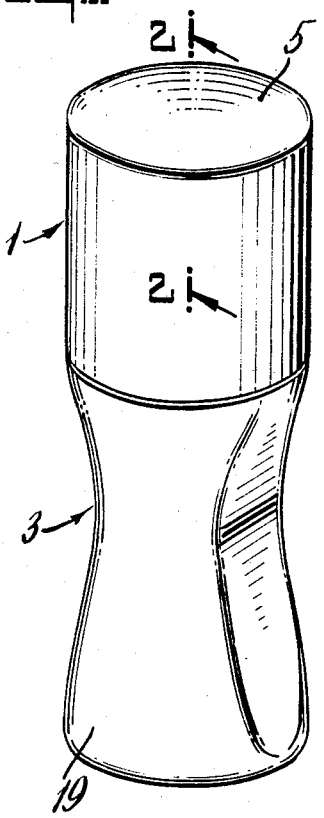
FIG. 1 is a perspective view of the combined dispenser and closure when the two are assembled.
Figure 2:
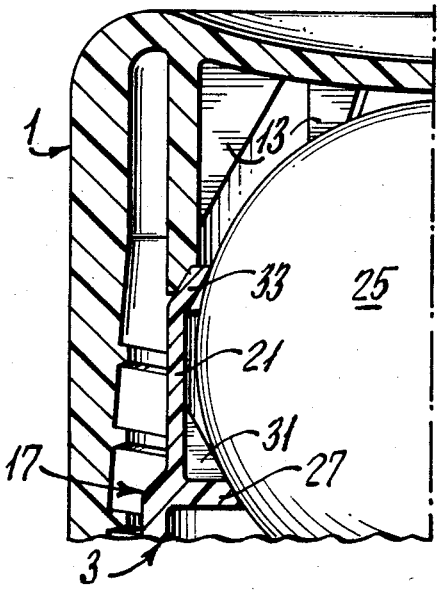
FIG. 2 is an enlarged partial cross-sectional view of the assembly shown in FIG. 1 taken along line 2—2 of FIG. 1.
Figure 3:
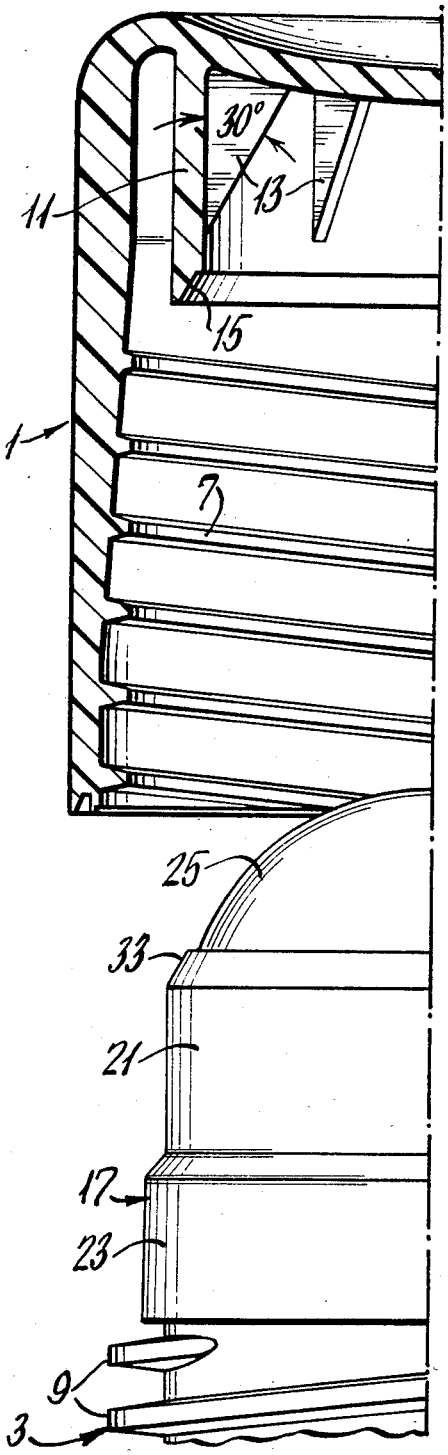
FIG. 3 is an enlarged partial view of a closure and upper section of a dispenser embodied in the present invention showing the closure disengaged from the dispenser, the closure being shown in longitudinal cross section and the upper end of the dispenser shown in perspective.

Referring to the drawings in which the numbers refer to the same structure in the various views, the closure is shown generally at 1 and the dispenser at 3.

Closure 1 is preferably formed as a hollow cylinder having a roof 5 and internal threads 7. The lower thread members of internal threads 7 will engage external threads 9 near the base of the neck of dispenser 3. By means of the combination of internal threads 7 and external threads 9, closure 1 may be screwed on to dispenser 3.

Closure 1 is also provided with a skirt 11 that depends from the underside of roof 5. Skirt 11 can also be formed as a hollow cylinder following generally the outer contour of closure 1. Skirt 11 is generally perpendicular to the roof 5. As will be described in more detail below, this construction enables the force exerted by skirt 3, when applied to the dispenser, to be exerted in a substantially vertical direction.

To provide rigidity to skirt 11 and to minimize its deformation when applied to the dispenser as described below, a plurality of radially disposed bracing ribs 13 are secured to the inner wall of skirt 11. These are generally triangular in outline, one leg of the triangle being secured to the undersurface of roof 5 and another leg of the triangle being secured to the cylindrical wall of skirt 11.

The number of ribs 13 that may be secured to skirt 11 can obviously vary. However, it has been found that six equally spaced ribs around the circumference of skirt 11 give it the requisite rigidity.

The lower margin of skirt 11 is preferably provided with a bevelled surface 15. This is designed to engage and seal retaining ring 17 as described in greater detail below.

The closure 1 may be fabricated in a variety of fashions and from a variety of materials. In the preferred aspect of this invention, the closure is preferably molded as a unitary piece from a thermoplastic resin which would include the closure proper, the dependent skirt 11 and the ribs 13. The material of choice for molding this unitary piece is polypropylene.

The thickness of the various components may also vary somewhat but should be designed with its function in mind. Thus, the cylindrical wall of skirt 11 should be sufficiently thick to assist in avoiding flaring when pressure is applied to it. Similarly, ribs 13 may be constructed in various fashions. In one modification, the rib was constructed so that its free edge formed an angle of 30° with the side wall of skirt 11. As to the thickness of ribs 13, a width of about from 0.01 inches to 0.05 inches and preferably 0.020 inches has been found to be appropriate.

As indicated above, the present closure has particular application when used in conjunction with a roll-on dispenser of the type shown at 3. This dispenser generally comprises a container 19 for storing the material to be dispensed. Mounted on top of the neck of container 19 there is provided a retaining ring 17. This is preferably mounted on the neck of container 19 by means of snap-on fit. Retaining ring 17 comprises a ball engaging and retaining section 21 and a container neck engaging section 23. Ball retaining section 21 is formed generally as a hollow cylinder having an opening at the top and bottom thereof. The opening in the top of section 21 is sufficiently large so that a roll-on ball may be pushed through the opening under pressure and yet retained within this section while the dispenser is being used. The lower end of section 21 is provided with a floor 27 that has a central opening through which the lower end of the ball 25 may extend a short distance. This enables the ball to pick up liquid material stored in the container when the ball is rotated. The diameter of the central opening in floor 27 will be dimensioned so that the ball 25 cannot slip through it and yet permit enough of the surface of the ball to extend below floor 27 so as to be in a position to pick up liquid when the ball 25 is rotated. To facilitate the rotation of the ball and to prevent impeding the flow of liquid material, ball 25 is supported by a plurality of supporting lugs 31. It has been found that three equally spaced lugs are adequate to do the job.

In use, container 19 is filled with the liquid to be dispensed. Ball 25 is then snapped into ball retaining section 21 and this assembly is then snapped on to the neck of container 19. Closure 1 is then screwed on to the neck of container 19 and is turned until the bevel 15 of skirt 11 engages the upper end 33 of ball retaining section 21. In this fashion, element 33 is urged against ball 25 thus forming a seal which will prevent the leaking of the fluid contents of the container. At the same time, because of the rigidity afforded skirt 11 by virtue of the presence of ribs 13, the flaring of skirt 11 is avoided and the liquid seal is maintained.

By constructing closure 1 so that skirt 11 is essentially at right angles to roof 5, it enables the force that is exerted by the roof when a torque is applied to closure 1 to be distributed mainly in the vertical direction of skirt 11. This will maximize the force that is available to make the seal between element 33 and the ball surface. Furthermore, because skirt 11 supported by ribs 13 prevents the flaring of this skirt, this does not disturb the seal. Because of this construction, it has been found that only a single seal is necessary to obtain a package that is sufficiently liquid tight. This is to be contrasted with the device shown in U.S. Pat. No. 4,164,377 in which a double seal is suggested.

The combination of closure and roll-on type dispenser described herein, although it obviously has other utility, is especially useful in the packaging of liquid products that are based on a vehicle comprising a liquid silicone and more specifically, a volatile liquid silicone e.g. cyclomethicone. One type of product in which it is particularly beneficial is the liquid silicone based antiperspirant compositions.

The liquid composition in connection with which the present packaging system is especially useful will usually be an essentially anhydrous composition. However, aside from the liquid silicone vehicle, other ingredients may also be contained in the composition. Usually, the product will be a liquid product in which the liquid silicone will be a volatile silicone and which will be present in said composition at a level in the range of from about 10% to about 85% by weight based on the total weight of the composition.

Although these liquid products have been characterized as being essentially anhydrous, this does not preclude the compositions in which a small quantity of water is present e.g. up to about 10% by weight. In addition, the liquid products may contain a physiologically active material (e.g. antiperspirant material), surfactants, suspending agents, solvents that facilitate the distribution of the suspending agents, perfumes, etc.

When the physiologically active material is to be an antiperspirant material, any of a variety of such agents that are well known in this art can be employed. By way of example, mention might be made of aluminum chlorhydroxide, aluminum chloride, aluminum chlorohydrex propylene glycol complex, aluminum zirconium complexes, sodium aluminum chlorohydroxy lactate or mixtures thereof. The quantity of physiologically active material, and particularly the antiperspirant material, that may be present in the composition may vary somewhat. Generally, it will be present in the liquid composition at a level of from about 12% to about 50% by weight based on the total weight of the liquid product.

The following Examples are typical examples of liquid antiperspirant compositions which are advantageously used with the closure and container system described herein. It is understood, however, that the invention is not limited thereto.

EXAMPLE 1

Formula BA 1459-4

| | % by Wt. |
|---|---|
| Aluminum zirconium trichlorohydrate, Micro Dry AZ-4 (Micro Dry AZ-4 Reheis) | 24.00 |
| Dimethyl dioctadecyl ammonium hectorite (Bentone 38) | 2.50 |
| Alcohol SD-40, anhydrous (Brucine sulfate) | 2.50 |
| Cyclomethicone (Siloxane SWS 03314, Stauffer) | 71.00 |
| | 100.00 |

Appearance: Opaque suspension
Color: Off White
Fragrance: Unscented
Viscosity: Initial 1700±500 cps (#2 spindle 20 RPM, 15 seconds) at room temperature. Overnight: 1700 cps±500 cps
Total Aluminum in formula: 4.08±0.40%
Total Zirconium in formula: 3.48±0.34%
Total Chloride in formula: 4.20±0.42%

EXAMPLE 2

Formula BA 1459-28

| | % by Wt. |
|---|---|
| Aluminum zirconium trichlorohydrate, Micro Dry AZ-4 (Micro Dry AZ-4, Reheis) | 24.00 |
| Dimethyl dioctadecyl ammonium hectorite (Bentone 38) | 2.50 |
| Alcohol SD-40, anhydrous (Brucine sulfate) | 2.50 |
| Perfume | 0.30 |
| Cyclomethicone (Siloxane SWS 03314, Stauffer) | 70.70 |
| | 100.00 |

Appearance: Opaque suspension
Color: Off white
Fragrance: Floral bouquet
Viscosity: Initial 1700±500 cps (#2 spindle 20 RPM, 15 seconds) at room temperature. Overnight: 1700 cps±500 cps
Total Aluminum in formula: 4.08±0.40%
Total Zirconium in formula: 3.48±0.34%
Total Chloride in formula: 4.20±0.42%

EXAMPLE 3

Formula BP 1664-21

| | % by Wt. |
|---|---|
| Aluminum zirconium tetra-chlorohydrex-glycine powder W-369 (Wickenol W-369) | 24.00 |
| Dimethyl dioctadecyl ammonium hectorite (Bentone 38) | 2.50 |
| Alcohol SD-40, anhydrous (Brucine sulfate) | 1.75 |
| Cyclomethicone (Siloxane SWS 03314, Stauffer) | 50.17 |
| Cyclomethicone (Siloxane SWS F-222, Stauffer) | 21.50 |
| Perfume | 0.08 |
| | 100.00 |

Appearance: Opaque suspension
Color: Off white
Fragrance: Floral bouquet
Viscosity: Initial 1500±400 cps 18–24 Hours: 1500±400 cps (#4 Spindle 20 RPM, 15 seconds)
Density: 1.10±0.05 g/cc at 25° C.
Total Aluminum in formula: 3.62±0.36%
Total Zirconium in formula: 3.34±0.33%
Total Chloride in formula: 4.26±0.43%
Total Glycine in formula: 2.88±0.29%

The effectiveness of the seal that is obtained with the combination of closure and dispenser described has been tested experimentally. For the basis of comparison, other packaging systems were also tested. These are described below.

Laboratory tests designed to evaluate the seal efficiency of the standard ring-cap seal configuration as shown in U.S. Pat. No. 2,749,566 showed significant silicone oil seepage past the ball-ring seal, particularly at storage temperatures about 100° F. Similar tests conducted with closures modified as per the present invention and depicted in the attached drawings showed no leakage of silicone oils past the ball-ring seal after extended inverted storage at 125° F.

It is apparent that the closure configuration of Thomas U.S. Pat. No. 2,749,566 is adversely affected by thermal factors due to circumferential expansion at elevated temperatures. The closure shown in the drawings of the present case shows no adverse effects due to thermal factors since the depending sealing skirt will expend in a substantial vertical direction not affecting the ring-ball seal.

The test protocol involves the use of antiperspirant formulations similar to those shown in Examples 2 and 3 in plastic bottles fitted with ring-cap assemblies as shown in the Thomas U.S. Pat. No. 2,749,566 and the drawings of the present case, respectively. Test closures are applied to a torque of 12–15 in-lb. and stored inverted at ambient temperatures, 104° F. and 125° F. for a period of two weeks. Samples are subsequently evaluated for seal efficiency by observing the degree of silicone oil seepage past the ring-ball seal.

Although the invention has been described with reference to specific forms thereof, it will be understood that many changes and modifications may be made without departing from the spirit of this invention.

What is claimed is:

1. In combination a closure and a dispenser container, said dispenser container comprising a container body having an upper open end and rotatable applicator; said rotatable applicator being removably mounted in the upper end of said container by means of a flexible retaining means, said flexible retaining means being adapted to be urged inwardly toward said rotatable applicator thereby forming a seal sealing the interior of said container from the atmosphere; said closure comprising a cap being provided with an upper inner surface and a lateral inner surface, skirt means provided with an inner surface and depending from and being integral with said upper inner surface of said cap; said skirt means being spaced inwardly of said lateral inner surface of said cap; said skirt means also being provided with bracing means to prevent deformation of said skirt means when pressure is applied to said skirt means when the said closure is mounted on said dispenser; said bracing means comprising a plurality of radially disposed bracing ribs secured to and extending inwardly of said inner skirt means surface; said skirt means being sufficiently long and adapted to apply pressure on said retaining means to urge the latter against said rotatable applicator means when said closure is in place on said roll-on dispenser.

2. The combination according to claim 1 in which said closure takes the form of a hollow cylinder having a horizontal roof that is essentially perpendicular to the said skirt means.

3. The combination according to claim 2 in which said skirt means also has the form of a hollow cylinder that depends from the undersurface of said roof.

4. The combination according to claim 3 in which the lower margin of said skirt means is provided with a bevel which is adapted to engage said flexible retaining means.

5. The combination according to claim 4 wherein the internal surface of said closure walls are threaded and adapted to be screwed on to said container.

* * * * *